US007056572B1

(12) United States Patent
Smith et al.

(10) Patent No.: US 7,056,572 B1
(45) Date of Patent: Jun. 6, 2006

(54) THIN, SOFT BATH TISSUE HAVING A BULKY FEEL

(75) Inventors: Michael John Smith, Neenah, WI (US); Ryan Leslie Fulscher, East Moline, IL (US); Anne Catherine Paschke, Appleton, WI (US); Irene Beatrice Strohbeen, Menasha, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 975 days.

(21) Appl. No.: 09/679,767

(22) Filed: Oct. 5, 2000

(51) Int. Cl.
*B32B 7/00* (2006.01)
*B32B 7/02* (2006.01)

(52) U.S. Cl. ..... 428/211.1; 428/338; 428/537.5; 428/906

(58) Field of Classification Search ..... 428/156, 428/338, 220, 215, 213, 152, 153, 154, 162, 428/163, 165, 167, 171, 172, 174, 175, 179, 428/181, 187, 537.5, 906, 211.1; 162/109, 162/113, 116, 117, 118, 205, 210, 204, 361, 162/206, 207, 362
See application file for complete search history.

(56) References Cited

U.S. PATENT DOCUMENTS

| | | | | |
|---|---|---|---|---|
| 4,659,608 | A | 4/1987 | Schulz | 428/171 |
| 4,759,967 | A | 7/1988 | Bauernfeind | 428/154 |
| 4,803,032 | A | 2/1989 | Schulz | 264/284 |
| 4,834,838 | A | 5/1989 | Klowak | 162/109 |
| 4,978,565 | A | 12/1990 | Pigneul et al. | 162/111 |
| 5,158,521 | A | 10/1992 | Singh | 112/117 |
| 5,215,626 | A | 6/1993 | Ampulski et al. | |
| 5,494,554 | A * | 2/1996 | Edwards et al. | 162/111 |
| 5,501,768 | A | 3/1996 | Hermans et al. | |
| 5,573,830 | A | 11/1996 | Schulz | 428/156 |
| 5,597,639 | A | 1/1997 | Schulz | 428/156 |
| 5,620,776 | A | 4/1997 | Schulz | 428/156 |
| 5,656,132 | A | 8/1997 | Farrington, Jr. et al. | 162/117 |
| 5,667,636 | A | 9/1997 | Engel et al. | 162/117 |
| 5,693,403 | A | 12/1997 | Brown et al. | 478/153 |
| 5,728,268 | A | 3/1998 | Weisman et al. | 162/109 |
| 5,743,999 | A | 4/1998 | Kamps et al. | 162/113 |
| 5,746,887 | A | 5/1998 | Wendt et al. | 162/116 |
| 5,779,860 | A | 7/1998 | Hollenberg et al. | 162/206 |
| 5,795,440 | A | 8/1998 | Ampulski et al. | 162/117 |
| 5,817,213 | A | 10/1998 | Ostermayer et al. | 428/152 |
| 5,855,738 | A | 1/1999 | Weisman et al. | 162/113 |
| 5,874,156 | A | 2/1999 | Schulz | 428/15 L |
| 5,888,347 | A | 3/1999 | Engel et al. | 162/117 |

(Continued)

FOREIGN PATENT DOCUMENTS

DE 44 14 238 A1 10/1995

(Continued)

OTHER PUBLICATIONS

Patent Cooperation Treaty Search Report from the International Search Authority, International Application No. PCT/US 01/31031 dated Apr. 29, 2002.

*Primary Examiner*—Michael C. Miggins
(74) *Attorney, Agent, or Firm*—Gregory E. Croft

(57) ABSTRACT

Low density, resilient webs are highly calendered to significantly increase density. The resulting tissue has low caliper and stretch but retains good Void Volume and premium-like softness.

30 Claims, 4 Drawing Sheets

U.S. PATENT DOCUMENTS

| | | | | |
|---|---|---|---|---|
| 5,900,114 | A | 5/1999 | Brown et al. | 162/117 |
| 5,904,812 | A * | 5/1999 | Salman et al. | 162/117 |
| 5,972,456 | A | 10/1999 | Esquivel | |
| 5,980,691 | A | 11/1999 | Weisman et al. | 162/117 |
| 6,077,390 | A | 6/2000 | Salman et al. | 162/117 |
| 6,083,346 | A | 7/2000 | Hermans et al. | 162/115 |
| 6,106,670 | A | 8/2000 | Weisman et al. | 162/109 |
| 6,149,767 | A | 11/2000 | Hermans et al. | 162/109 |
| 6,162,327 | A | 12/2000 | Batra et al. | 162/109 |

FOREIGN PATENT DOCUMENTS

| | | |
|---|---|---|
| EP | 0 956 804 A1 | 11/1999 |
| WO | WO 95/29294 A1 | 11/1995 |

* cited by examiner

THIN, SOFT BATH TISSUE HAVING A BULKY FEEL

BACKGROUND OF THE INVENTION

Commercially available bath tissues generally fall into either of two categories. One of the categories is the premium segment, where softness is a major characteristic. The softness is at least partially due to high stretch and sheet caliper, which tend to impart a "cushiony" feel. A disadvantage of these premium products is that the number of sheets that can be wound on a roll of bath tissue is limited by the caliper of the sheets. This is because the average bath tissue dispenser can only accommodate rolls of bath tissue having a roll diameter of about 5 inches or less. Simply increasing the sheet count on a roll of premium tissue would result in a roll that is too large in diameter to fit within the average bath tissue dispenser. Alternatively, more sheets could be added to the roll by increasing the winding tension as the roll is wound, but this would remove stretch and reduce the sheet caliper and consequently reduce the softness of the product. As a result, products in the premium category typically have sheet counts of about 600 sheets per roll or less.

The other category is the value segment, which provides a large number of sheets per roll. The number of sheets per roll for bath products in this category is typically about 1000, but the sheets are characterized by low stretch and low bulk and hence exhibit lower softness than the premium products.

Hence there is a need for a bath tissue product that provides more sheets per roll than the premium segment products, but provides a comparably soft product.

SUMMARY OF THE INVENTION

It has now been discovered that a relatively high sheet count roll of bath tissue can be made with a tissue sheet having a low caliper (low bulk) and low stretch, yet at the same time has a soft, bulky feel.

Hence, in one aspect, the invention resides in a roll of bath tissue comprising a wound continuous tissue basesheet having spaced-apart transverse lines of perforations which define individual tissue sheets for detachment in use, said tissue basesheet having a geometric mean stretch of 11% or less, a single sheet caliper of about 0.01 inch or less, and a Void Volume of about 8.0 grams or greater per gram of tissue.

More specifically, the roll of bath tissue can have from about 600 to about 800 individual tissue sheets, more particularly from about 650 to about 750 sheets, alternatively from about 600 to about 750 sheets, and alternatively from about 650 to about 800 sheets. Stated differently, the total length of the wound continuous basesheet can be from about 2460 to about 3280 inches.

As used herein, "geometric mean stretch" is defined as the square root of the product of the machine direction stretch and the cross direction stretch and is measured using a constant rate of extension tensile tester. A three-inch wide strip is cut using a standard specimen cutter. The specimen is placed in both the upper and lower clamps of an Instron using as 2 inch jaw span. With the crosshead speed at 10 inches per minute, break sensitivity at 65% and slack compensation at 25 grams, the specimen is elongated until failure. The point of failure is detected and the elongation, measured as a percent of the initial length is recorded as the stretch. A total of ten specimens were run in each direction under standard laboratory conditions (23° C., 50% relative humidity) to obtain average values.

The geometric mean stretch of the tissue sheets of this invention can be about 11% or less, more specifically about 10% or less, and still more specifically from about 7 to about 10%.

The "caliper" of a single sheet is measured using an Emveco Model 200-A Micrometer from Emveco, Inc., Newberg, Oreg. With the clearance set at 0.50 inches and loading pressure at 2.00 kPa (132 g/in$^2$) a specimen is placed between the pressure foot (2500 mm$^2$ in diameter) and anvil. The pressure foot is lowered, contacts the tissue for approximately 3 seconds and then rises back to its original position. The test instrument automatically records each reading and averages them upon completion of a sample. In this work, readings from a total of 5 specimens were averaged together and recorded as one value.

The caliper of the tissue sheets of this invention can be about 0.01 inch or less, more specifically about 0.0095 inch or less, and still more specifically from about 0.007 to about 0.01 inch.

The Void Volume is determined by saturating a tissue sheet with a non-polar liquid and measuring the amount of liquid absorbed by the sheet. The volume of liquid absorbed is equivalent to the Void Volume within the sheet structure. For convenience, however, the Void Volume is expressed as grams of liquid absorbed per gram of fiber in the sheet, hereinafter referred to as "grams per gram of tissue". The procedure is more specifically described in U.S. Pat. No. 5,494,554 issued Feb. 27, 1996 to Edwards et al., which patent is hereby incorporated by reference.

The Void Volume of the tissue sheets of this invention can be about 8.0 grams or greater per gram of tissue, more specifically about 10.0 grams or greater per gram of tissue, and still more specifically from about 8.0 to about 11 grams or greater per gram of tissue.

Basesheets suitable for purposes of this invention can be made using any process that produces a low density, resilient tissue structure. Such processes include uncreped throughdried, creped throughdried and modified wet press processes. Exemplary patents include U.S. Pat. No. 5,656,132 issued Aug. 12, 1997 to Farrington et al. and U.S. Pat. No. 6,083,346 issued Jul. 4, 2000 to Hermans et al., both of which are hereby incorporated by reference. The softness of the products of this invention is at least in part derived from the low-density, resilient nature of the web produced by the foregoing tissue processes, which can produce unusually high levels of stretch and caliper. By applying a high calendering load to these webs, the stretch and caliper, which are properties that normally enhance softness, are reduced. However, it has been discovered that calendering these webs under a high load still produces a soft absorbent tissue despite the resulting relatively low caliper and stretch. Suitable calendering loads can be about 200 pounds per linear inch (pli) or greater, more specifically about 300 pli or greater, still more specifically from about 250 to about 450 pli, and still more specifically from about 300 to about 400 pli. It is believed that the softness is largely due to the substantial Void Volume and surface smoothness that remains in the tissue after such high load calendering. And because of low caliper, relatively high sheet counts (600–800) of soft tissue can be wound onto a roll.

DETAILED DESCRIPTION OF THE DRAWINGS

Figure 1:
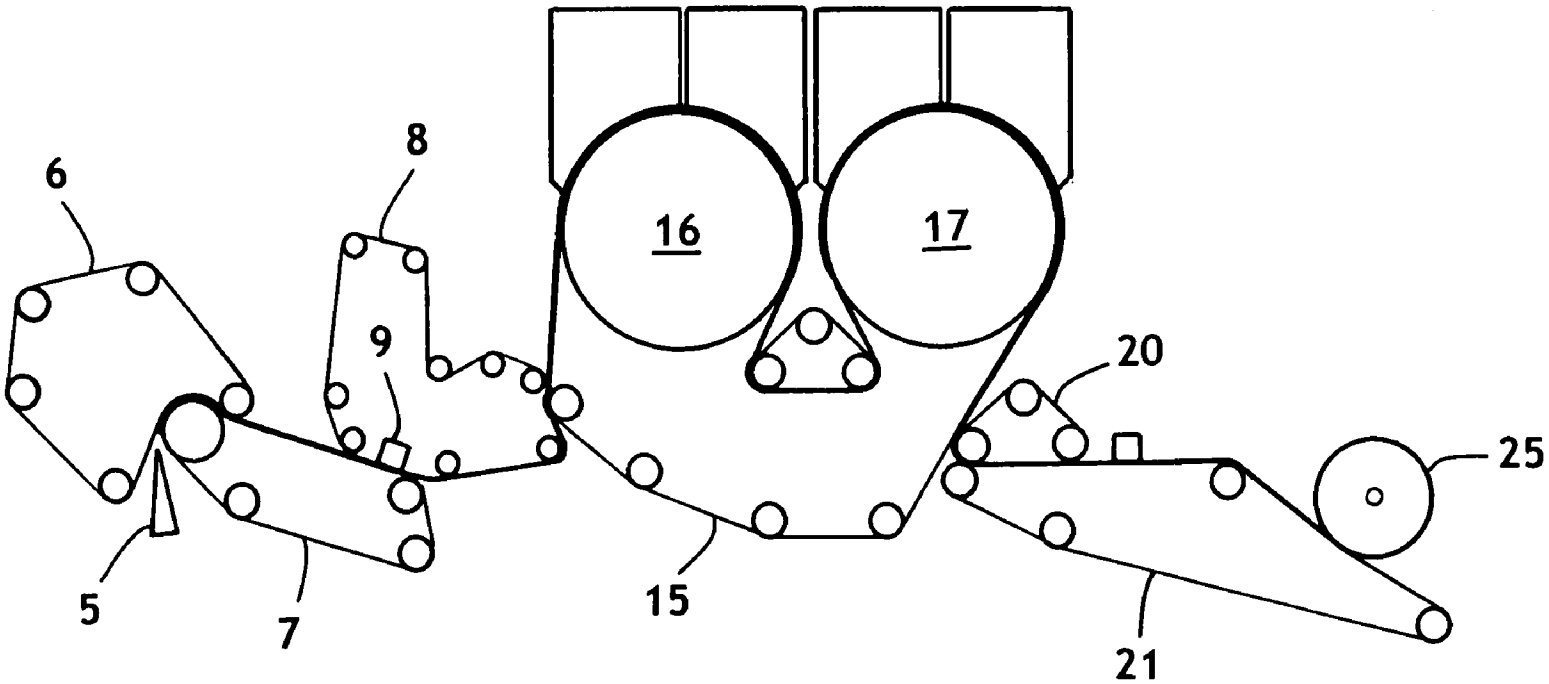
FIG. 1 is a schematic process flow diagram of a suitable throughdrying method for making basesheets for purposes of this invention.

Referring to FIG. 1, a schematic method of making a low density, resilient basesheet suitable for purposes of this invention is illustrated. In particular, shown is an uncreped through-air-dried tissuemaking process in which a multi-layered headbox 5 deposits an aqueous suspension of papermaking fibers between forming wires 6 and 7. The newly formed web is transferred to a slower moving transfer fabric with the aid of a vacuum box 9. The web is then transferred to a throughdrying fabric 15 and passed over throughdryers 16 and 17 to dry the web. After drying, the web is transferred from the throughdrying fabric to fabric 20 and thereafter briefly sandwiched between fabrics 20 and 21. The dried web remains with fabric 21 until it is wound up at the reel 25. Thereafter, the web can be unwound, heavily calendered and converted into the final tissue product in a conventional manner.

Figure 2:
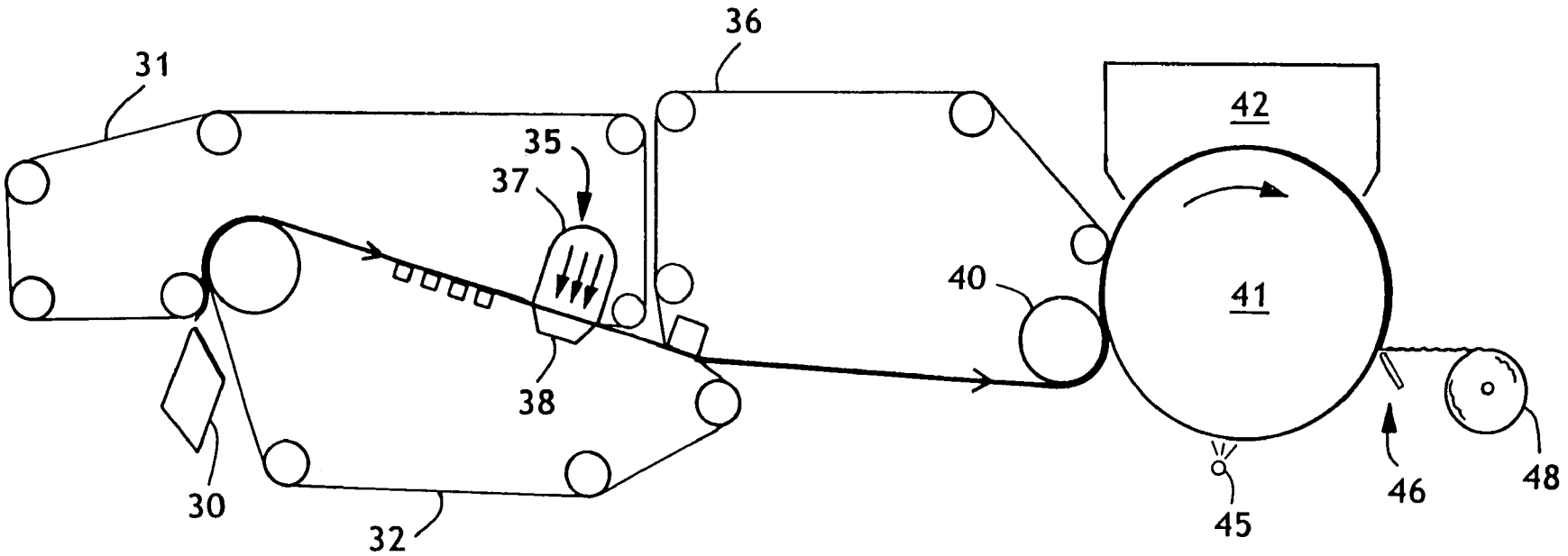
FIG. 2 is a schematic process flow diagram of a suitable modified wet press method for making basesheets for purposes of this invention.

FIG. 2 is a schematic process flow diagram of a modified wet press method suitable for making low density sheets useful for purposes of this invention. Shown is the headbox 30 depositing the aqueous suspension of papermaking fibers between forming fabrics 31 and 32 to form an embryonic web. The web passes through an air press 35 while constrained between the transfer fabric 36 and the forming fabric 32. The air press 35 comprises a pressurized plenum 37 and a collection box 38 operated under vacuum. The result is non-compressive dewatering of the web, which promotes the formation of a lower density web. After the air press, the web is transferred to the transfer fabric, which serves to transfer the dewatered web to the surface of the Yankee dryer 41 via pressure roll 40. The Yankee dryer is equipped with a hood 42 to conserve energy and improve the drying rate. Creping adhesive is sprayed onto the surface of the Yankee dryer with a suitable spray boom 45 to improve adhesion of the web. The dried web is thereafter creped from the surface of the Yankee with a doctor blade 46 and wound into a parent roll 48 for subsequent calendering and converting.

Figure 3:
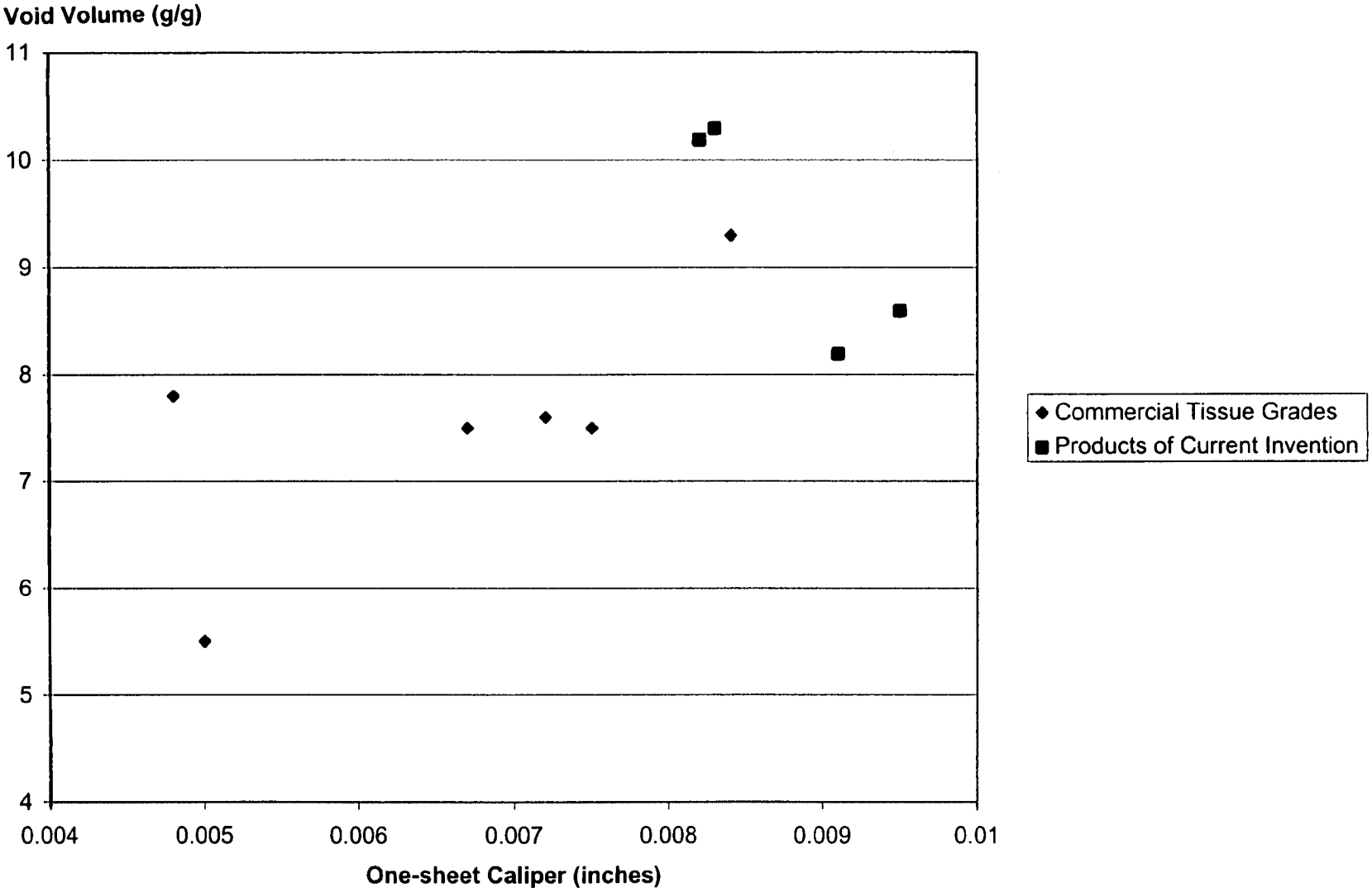
FIGS. 3 and 4 are plots of sheet caliper, geometric mean stretch and Void Volume for a number of commercially available bath tissues and examples of the products of this invention.
Figure 4:
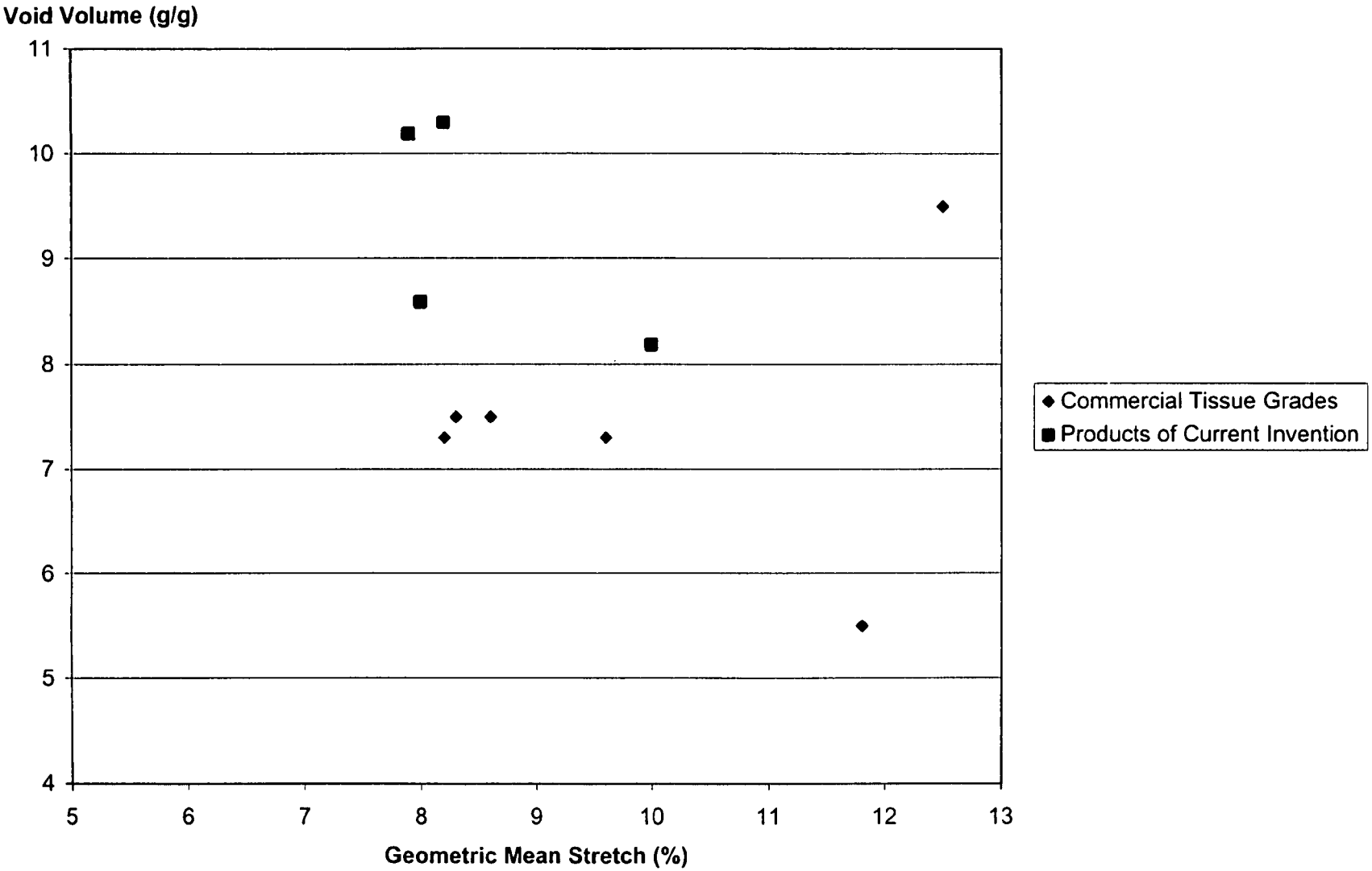

FIGS. 3 and 4 are plots of one-sheet caliper (inches) vs. Void Volume (grams per gram) and geometric mean stretch (percent) vs. Void Volume (grams per gram), respectively, illustrating the unique combination of properties of the sheet products of this invention compared to sheets taken from several different commercially available rolls of bath tissue.

EXAMPLES

Example 1

Uncreped Throughdried Tissue

A three-layered tissue in accordance with this invention was made as described in FIG. 1. The furnish for the two outer layers consisted of 100% eucalyptus fibers which had previously been treated with a softening agent. In particular, the eucalyptus fibers were dispersed in a hydrapulper and, after pulping, the slurried furnish was transferred to a stock chest and treated with a bonding agent, Parez 631-NC which is commercially available from Cytec Industries, Inc., at a dosage of 1 kg/tonne under good mixing. After allowing the slurry to mix for 20 minutes, an imidazoline softening agent, C-6092 from Witco Corp., was added at a dosage of 7.5 kg/tonne of active chemical per metric ton of fiber, also under good mixing conditions. After an additional 20 minutes of mixing time, the slurry was de-watered using a belt press to approximately 32% consistency. Because this particular chemical addition method removes most non-retained softening agent from the water phase during tissue forming, the resultant product can be produced with exceptionally good tensile strength. The thickened stock was placed in a high-density storage chest until needed during tissue manufacturing.

To form the tissue, a three-layered headbox was employed, through which the two outer layers contained the same treated eucalyptus fibers described above and the center layer contained 100% refined softwood fiber. The resulting three-layer sheet structure was formed on a twin-wire, suction form roll. The speed of the forming fabric was 1920 feet per minute (fpm). The newly-formed web was then de-watered to a consistency of about 20–27% using vacuum suction from below the forming fabric before being transferred to the transfer fabric, which was traveling at 1600 fpm (20% rush transfer). A vacuum shoe pulling about 9–10 inches of mercury vacuum was used to transfer the web to the transfer fabric. The web was carried over a pair of Honeycomb throughdryers operating at temperatures of about 375° F. and dried to a final dryness of about 97–99% consistency. The dried cellulosic web was rolled onto a core to form a parent roll of tissue.

The parent roll tissue was then converted into soft, absorbent rolls of toilet tissue of this invention using high-intensity calendering, wherein the tissue was passed through a calendering nip, at approximately 300 feet per minute (fpm), consisting of a rubber roll on top having a hardness of 4 P&J and a steel roll on the bottom with a 350 pounds per lineal inch (pli) sustainable nip pressure. Once calendered, the tissue was sent through a second calender nip at approximately 300 feet per minute (fpm), consisting of a rubber roll on top having a hardness of 75 Shore A and a steel roll on the bottom with a 100 pounds per lineal inch (pli) sustainable nip pressure. The tissue was then wound into individual rolls of toilet tissue having a sheet count in the range of from 600–700 sheets per roll. The resulting tissue product had a geometric mean stretch of 8.0%, a one-sheet caliper of 0.0095 inch and a Void Volume of 8.6 grams per gram. In an alternate embodiment, the calendered cellulosic web can also be embossed using techniques known in the art.

Example 2

Uncreped Throughdried Tissue

A tissue was made as described in Example 1, except the tissue was sent through a single nip calender stage with 30 pounds per lineal inch sustainable nip pressure. The resulting tissue product had a geometric mean stretch of 10.0%, a one-sheet caliper of 0.0091 inch and a Void Volume of 8.2 grams per gram.

Example 3

Modified Wet-Pressed Tissue

A three-layered tissue in accordance with this invention was prepared as described in FIG. 2. The papermaking fibers were pretreated as described in Example 1. More specifically, the papermaking fibers were dispersed in a hydrapulper separately at 3.5% consistency for 20 minutes. Once in separate dump chests, the NSWK and eucalyptus pulps were diluted to approximately 2.0% consistency. Each pulp slurry was then pumped to separate machine chests. From the machine chests, the two pulps were blended together such that the resulting fiber split was 70% NSWK/30% eucalyptus. A bonding agent, Redi-bond 5330A (National Starch and Chemical Company), was added to the pulp stream feeding the center layer at a rate of 6.2 kg/tonne for strength control. The pulp blend was subsequently diluted to 0.05–0.06% consistency prior to forming.

A three-layered headbox was used to inject the slurry between two Lindsay Wire 2164B forming fabrics, in a twin-wire forming section. While disposed between the two forming fabrics and travelling at 1000 fpm, the embryonic web was transported over four vacuum boxes operating with respective vacuum pressures of approximately 11, 13, 14, and 19 inches of mercury vacuum. The embryonic web was passed through an air press including an air plenum and a collection box that were operatively associated and integrally sealed with one another. The air plenum was pressurized with air to 15 pounds per square inch gauge at approximately 150° F. and the collection box was operated at approximately 11 inches of mercury vacuum. The sheet was exposed to the resulting pressure differential of approximately 41.5 inches of mercury and air flow of 68 standard cubic feet per minute (SCFM) per square inch for a dwell time of 7.5 milliseconds over four slots, each ⅜ inch in length. The consistency of the web was approximately 30% just prior to the air press and 39% upon exiting the air press.

The de-watered web was transferred using a vacuum pick-up shoe operating at approximately 10 inches of mercury vacuum onto an Albany Wire 44X-30 GST throughdrying fabric. A silicone emulsion in water was sprayed onto the sheet side of the 44X-30 GST fabric just prior to transfer from the forming fabric to facilitate eventual transfer to the Yankee. The silicone was applied at a flow rate of 400 milliliters per minute at 1.0% solids. The throughdrying fabric was thereafter pressed against the surface of the Yankee dryer with a conventional pressure roll operating at a maximum pressing pressure of 350 pli. The fabric was wrapped over about 39 inches of the Yankee dryer surface by a transfer roll which was unloaded and slightly removed from the Yankee dryer. The web was adhered to the Yankee surface using an adhesive mixture of polyvinyl alcohol and AIRVOL 532 made by Air Products and Chemical Inc. and sorbitol in water applied by four #6501 spray nozzles by Spraying Systems Company operating at approximately 40 psig with a flow rate of about 0.4 gallons per minute (gpm). The spray had a solids concentration of about 0.5 weight percent. The sheet was creped from the Yankee at a final dryness of approximately 95% consistency and wound into a parent roll.

The parent roll was converted into soft, absorbent rolls of toilet tissue using high-intensity calendering as described in Example 1, except the calendering load was 250 pounds per lineal inch sustainable nip pressure. The resulting tissue product had a geometric mean stretch of 8.4%, a one-sheet caliper of 0.0082 inch and a Void Volume of 10.4 grams per gram.

Example 4

Modified Wet-Pressed Tissue

A tissue was made as described in Example 3, except that the tissue was stratified. The inner two layers consisted of NSWK which made up 50% of the weight of the tissue. The outer layer consisted of eucalyptus which constituted the other 50% of the weight of the tissue. When plied together the resulting tissue product had a geometric mean stretch of 7.9%, a one-sheet caliper of 0.0081 inch and a Void Volume of 10.3 grams per gram.

It will be appreciated that the foregoing examples, given for purposes of illustration, shall not be construed as limiting the scope of this invention, which is defined by the following claims and all equivalents thereto.

We claim:

1. A roll of bath tissue comprising a wound continuous tissue basesheet having spaced-apart transverse lines of perforations which define individual tissue sheets for detachment in use, said tissue basesheet having a geometric mean stretch of about 11% to about 7%, a single sheet caliper of about 0.01 inch or less, and a Void Volume of about 8.0 grams to about 11 grams per gram of tissue.

2. The roll of bath tissue of claim 1 having from about 600 to about 800 individual sheets per roll.

3. The roll of bath tissue of claim 1 having from about 650 to about 750 individual sheets per roll.

4. The roll of bath tissue of claim 1 having from about 600 to about 750 individual sheets per roll.

5. The roll of bath tissue of claim 1 having from about 650 to about 800 individual sheets per roll.

6. The roll of bath tissue of claim 1 wherein the tissue basesheet has a Void Volume of about 10.0 or greater.

7. The roll of bath tissue of claim 1 wherein the tissue basesheet has a geometric mean stretch of about 10% or less.

8. The roll of bath tissue of claim 1 wherein the tissue basesheet has a geometric mean stretch of from about 7 to about 10%.

9. The roll of bath tissue of claim 1 wherein the tissue basesheet has a caliper of 0.0095 inch or less.

10. The roll of bath tissue of claim 1 wherein the tissue basesheet has a caliper of from about 0.007 to about 0.01 inch.

11. A roll of bath tissue comprising a wound continuous single-ply, throughdried tissue basesheet having spaced-apart transverse lines of perforations which define individual tissue sheets for detachment in use, said single-ply tissue basesheet having a geometric mean stretch of about 11% to about 7%, a single sheet caliper of about 0.01 inch or less, and a Void Volume of about 8.0 grams to about 11 grams per gram of tissue.

12. The roll of bath tissue of claim 11 having from about 600 to about 800 individual sheets per roll.

13. The roll of bath tissue of claim 11 having from about 650 to about 750 individual sheets per roll.

14. The roll of bath tissue of claim 11 having from about 600 to about 750 individual sheets per roll.

15. The roll of bath tissue of claim 11 having from about 650 to about 800 individual sheets per roll.

16. The roll of bath tissue of claim 1 wherein the tissue basesheet has a Void Volume of about 10.0 or greater.

17. The roll of bath tissue of claim 11 wherein the tissue basesheet has a geometric mean stretch of about 10% or less.

18. The roll of bath tissue of claim 11 wherein the tissue basesheet has a geometric mean stretch of from about 7 to about 10%.

19. The roll of bath tissue of claim 11 wherein the tissue basesheet has a caliper of 0.0095 inch or less.

20. The roll of bath tissue of claim 11 wherein the tissue basesheet has a caliper of from about 0.007 to about 0.01 inch.

21. A roll of bath tissue comprising a wound continuous single-ply, uncreped throughdried tissue basesheet having spaced-apart transverse lines of perforations which define individual tissue sheets for detachment in use, said single-ply, uncreped throughdried tissue basesheet having a geometric mean stretch of about 11% to about 7%, a single sheet caliper of about 0.01 inch or less, and a Void Volume of about 8.0 grams to about 11 grams per gram of tissue.

22. The roll of bath tissue of claim 21 having from about 600 to about 800 individual sheets per roll.

23. The roll of bath tissue of claim 21 having from about 650 to about 750 individual sheets per roll.

24. The roll of bath tissue of claim 21 having from about 600 to about 750 individual sheets per roll.

25. The roll of bath tissue of claim 21 having from about 650 to about 800 individual sheets per roll.

26. The roll of bath tissue of claim 21 wherein the tissue basesheet has a Void Volume of about 10.0 or greater.

27. The roll of bath tissue of claim 21 wherein the tissue basesheet has a geometric mean stretch of about 10% or less.

28. The roll of bath tissue of claim 21 wherein the tissue basesheet has a geometric mean stretch of from about 7 to about 10%.

29. The roll of bath tissue of claim 21 wherein the tissue basesheet has a caliper of 0.0095 inch or less.

30. The roll of bath tissue of claim 21 wherein the tissue basesheet has a caliper of from about 0.007 to about 0.01 inch.

* * * * *